US010159291B1

(12) United States Patent
Ortega

(10) Patent No.: US 10,159,291 B1
(45) Date of Patent: Dec. 25, 2018

(54) SIDE RELEASE BUCKLE FASTENER WITH SEMI RIGID INSERTION STRUCTURE

(71) Applicant: Jose Luis Ortega, Irving, TX (US)

(72) Inventor: Jose Luis Ortega, Irving, TX (US)

(73) Assignee: INVERTLOCK DFM, LLC, Irving, TX (US)

( * ) Notice: Subject to any disclaimer, the term of this patent is extended or adjusted under 35 U.S.C. 154(b) by 0 days.

(21) Appl. No.: 15/338,321

(22) Filed: Oct. 31, 2016

(51) Int. Cl.

| | |
|---|---|
| ***A41F 1/00*** | (2006.01) |
| ***A44B 11/26*** | (2006.01) |
| ***A44B 11/25*** | (2006.01) |
| ***A43C 11/12*** | (2006.01) |
| ***A42B 3/08*** | (2006.01) |
| ***A42B 3/32*** | (2006.01) |

(52) U.S. Cl.
CPC ..... *A41F 1/008* (2013.01); *A42B 3/08* (2013.01); *A42B 3/326* (2013.01); *A43C 11/12* (2013.01); *A44B 11/2592* (2013.01); *A44B 11/266* (2013.01); *Y10T 24/1498* (2015.01); *Y10T 24/45246* (2015.01); *Y10T 24/45702* (2015.01)

(58) Field of Classification Search
CPC ..... A41F 1/008; Y10T 24/45246; Y10T 24/2106; Y10T 24/2142; Y10T 24/216; Y10T 24/141; Y10T 24/1498; Y10T 24/45702; A44B 11/266; A44B 11/2592; A44C 11/12; A42B 3/08; A42B 3/326
See application file for complete search history.

(56) References Cited

U.S. PATENT DOCUMENTS

| | | | | |
|---|---|---|---|---|
| 215,956 A * | 5/1879 | Miller | A44C 5/22 | 224/176 |
| 1,910,891 A * | 5/1933 | Freysinger | A41F 1/008 | 24/593.11 |
| 3,385,299 A * | 5/1968 | Le Roy | A61B 17/08 | 24/593.11 |
| 3,860,997 A * | 1/1975 | Van Riper, Jr. | B65D 63/1081 | 24/16 PB |
| 4,577,375 A * | 3/1986 | Beaussant | A62B 18/084 | 128/201.23 |
| 5,450,660 A * | 9/1995 | Frano | A44B 11/266 | 24/596.1 |
| 5,687,455 A * | 11/1997 | Alexander | B65D 63/1072 | 24/16 PB |
| 8,220,117 B2 * | 7/2012 | Lovato | A44B 11/266 | 24/573.09 |

(Continued)

*Primary Examiner* — Robert John Sandy
*Assistant Examiner* — Michael S Lee

(57) ABSTRACT

A quick fastening and disconnecting buckle fastener system is configured for improved ease of one handed adjustment. For reliable locking, and convenient operation the system incorporates lateral pivoting latches assembled within a receiving enclosure shell having entry and exit openings accommodating a lengthwise semi rigid insertion structure containing lateral opposing ridges. Said ridges cooperate with said latches in a manner allowing ease of continued entry directional movement and securely locking should motion be reversed. Purposeful disconnection is activated thru simultaneous press in of side levers releasing latch locking of insertion structure thereby allowing movement in a reversed direction. Use of aforementioned fastening device removes need for having to re-lace belt thru attachment loops or additional sliding hardware as means of adjustment.

2 Claims, 10 Drawing Sheets

(56) References Cited

U.S. PATENT DOCUMENTS

| | | | | |
|---|---|---|---|---|
| 2006/0174459 | A1* | 8/2006 | Bledsoe | A41F 1/008 24/634 |
| 2010/0011542 | A1* | 1/2010 | Badrenas Buscart | A44B 11/266 24/163 R |
| 2012/0174355 | A1* | 7/2012 | Fraze | A41F 1/008 24/68 A |
| 2015/0289600 | A1* | 10/2015 | Shirai | A44B 11/24 24/303 |

* cited by examiner

SIDE RELEASE BUCKLE FASTENER WITH SEMI RIGID INSERTION STRUCTURE

CROSS REFERENCE TO RELATED APPLICATIONS

This application claims the benefit of provisional patent application Ser. No. 62/247,205 file 2015 Oct. 28 by present inventor, the entire disclosure of which is incorporated by reference.

BACKGROUND—PRIOR ART

The following is a tabulation of some prior art that presently appears relevant:

U.S. patents

| U.S. Pat. No. | Kind Code | Issue Date | Patentee |
|---|---|---|---|
| 8,561,268 | B2 | 2013 Mar. 22 | Hortnagl |
| 2,867,812 | | 1959 Jan. 13 | Roth |
| 5,606,779 | | 1997 Mar. 4 | Lu |

U.S. patent application Publications

| Publication Nr | Kind Code | Publ. Date | Applicant |
|---|---|---|---|
| 2015/0033457 | A1 | 2015 Feb. 5 | Tryner |
| 2015/0113770 | A1 | 2015 Apr. 30 | Laatz |

BACKGROUND ART

There are many buckles, belts, straps, and fastener configurations in application today to secure objects. A significant number of them require cumbersome, time consuming disconnection of the belt or strap to subsequently allow tightening or loosening adjustment. For instance, in order to adjust a common buckle pants belt having a square or oval metal frame buckle and swiveling prong inserted into a hole of a belt that passes thru the buckle opening, the prong has to be disengaged from its current engagement hole, and subsequently be re-engaged with another hole. This type operation requires a non trivial level of manual dexterity finesse to achieve and usually is accomplished with two handed operation, one hand to control and manipulate the prong while the hand pulls and/or tugs on the belt. Oftentimes, on account of mechanical strength limits and manufacturing process restrictions, minimum allowable spacing between belt holes limits ability for finer incremental adjustments. Additionally, should a secured belt be currently under a continuous and high level of tensile load, it often can be awkward, time consuming, and a safety risk to manually disengage in order to adjust. Should a person have limited functionality in one or both hands, or have missing fingers, adjustment of a common buckle and prong pants belt can become a difficult, tedious, time consuming procedure.

Another type of fastening buckle style readily in use with straps, is a side release buckle with two laterally opposing latching prongs such as the one described in U.S. Pat. No. 4,150,464 to R. J. Tracy (1979). These style buckle configurations, while allowing for quicker and easier side release disconnection and connection, generally have strap attachment provisions that are sometimes difficult and cumbersome to manipulate, especially if the buckle is engaged, or if the belt is under significant tension. The issue becomes more pronounced should the buckle be a heavier duty type using a thick belt or webbing material with limited flexibility. As with the case of the common prong in hole buckle belt, adjustment of these Tracy type buckles when attached to heavy grade strapping typically requires disengagement and subsequent tedious manipulation of the strap thru multiple loops and or accessory slides or adjusters. It is very common to require additional slide or adjuster hardware with Tracy type buckle belts so as to properly constrain the slide-able stub end of the belt which usually gets doubled back. Additionally, Tracy style configurations have latches with catch surfaces subject to deforming in a manner which increases risk of sliding apart when under increased high tensile load.

Hortnagl, (Andreas U.S. Pat. No. 8,561,268, 2013) addresses aforementioned issue of Tracy catch surfaces deforming in a way that adds to risk of opening, with a buckle having a reversed latch orientation which bias catch surfaces in a mannert encouraging staying locked together under increased load. Hortnagl style buckle style belts however, also suffer Tracy type buckle drawback of usually necessitating disengagement so as to facilitate manipulation and adjustment of attached strapping, and especially when using heavy grade belt strap materials. With heavy duty thicker gage belts designed to sustain reliable operation under high tension, their functional necessity to have a secure grasp of an stub end of a thick strap subsequently disadvantages their ease of slide-able strap re-adjustment.

In contrast to aforementioned buckle fastening systems outlined above, there are alternative fastening systems configured to facilitate incremental insertion and adjustment, and can often allow for adjustment while remaining engaged or under load. These systems incorporate features configured for ratcheting type incremental engagement, such as, Lu 1997, U.S. Pat. No. 5,606,779 and Laatz US2015/0113770. Lu and Laatz type intricate designs generally contain structure having a centrally placed singular lever for mechanical engagement with sloping centrally located teeth of an insertion strap. These type ratcheting-buckle structures in general tend to have complex assembly configurations, necessitating use of many intricate parts with delicate cooperative arrangements. Subsequently production of such ratchet styles generally have significantly higher manufacture costs. Additionally the intricacy of these mechanisms are at increased degradation risk from repeated exposure to environmental contaminants which often allows fine debris ingress resulting in propensity for jamming or premature wear.

Tryner's application 2015/0033457 teaches an adjustable chin strap system with a ratchet connector engaging a plurality of centrally located engagement teeth. Release actuation of Tryner's system requires placing significant force to a central lever segment in a downward, orthogonal direction with respect to the plane defined by main body surface of connector housing. Such a downward force requirement severely limits simultaneous ergonomic use of actuation hand's unengaged fingers ability to induce slide-able motion to the corresponding strap. I personally have found it much easier to release Tryner's device with a two handed application method and have witnessed same approach preference with other users.

Roth U.S. Pat. No. 2,867,812, teaches a rigid metal latch bolt with pairs of notches along its lateral margins as its securing insertion structure. Roth's exposed lateral rigid metal notches are somewhat analogous to serrated edges incorporated in cutting tools such as saws, knives, teeth, etc.

Use of this type structure would be highly unsuitable in belt or strap applications requiring flexibility and repeated manual manipulation which sometimes can be quick and slide-ably abrupt.

SUMMARY

An improved fastening device containing a lengthwise semi-rigid insertion structure with lateral opposing ridges configured to slide-ably enter a receiving enclosure shell assembly having lateral pivoting latches is hereby introduced. These latches are arranged in an inverted fashion and are given compliancy bias so as to have their detent tips move inward, ensuring locking together with insertion structure upon reversed movement. Arrangement produces a simplified ratcheting effect facilitating ease of adjustment. Release of insertion structure is achieved by press in of exposed lateral lever surfaces of thus removing locking engagement with insertion structure.

DRAWINGS—FIGURES

FIGS. 1 & 1' show full assemblies having top and bottom orientation of belt embodiment.

Figure 7:
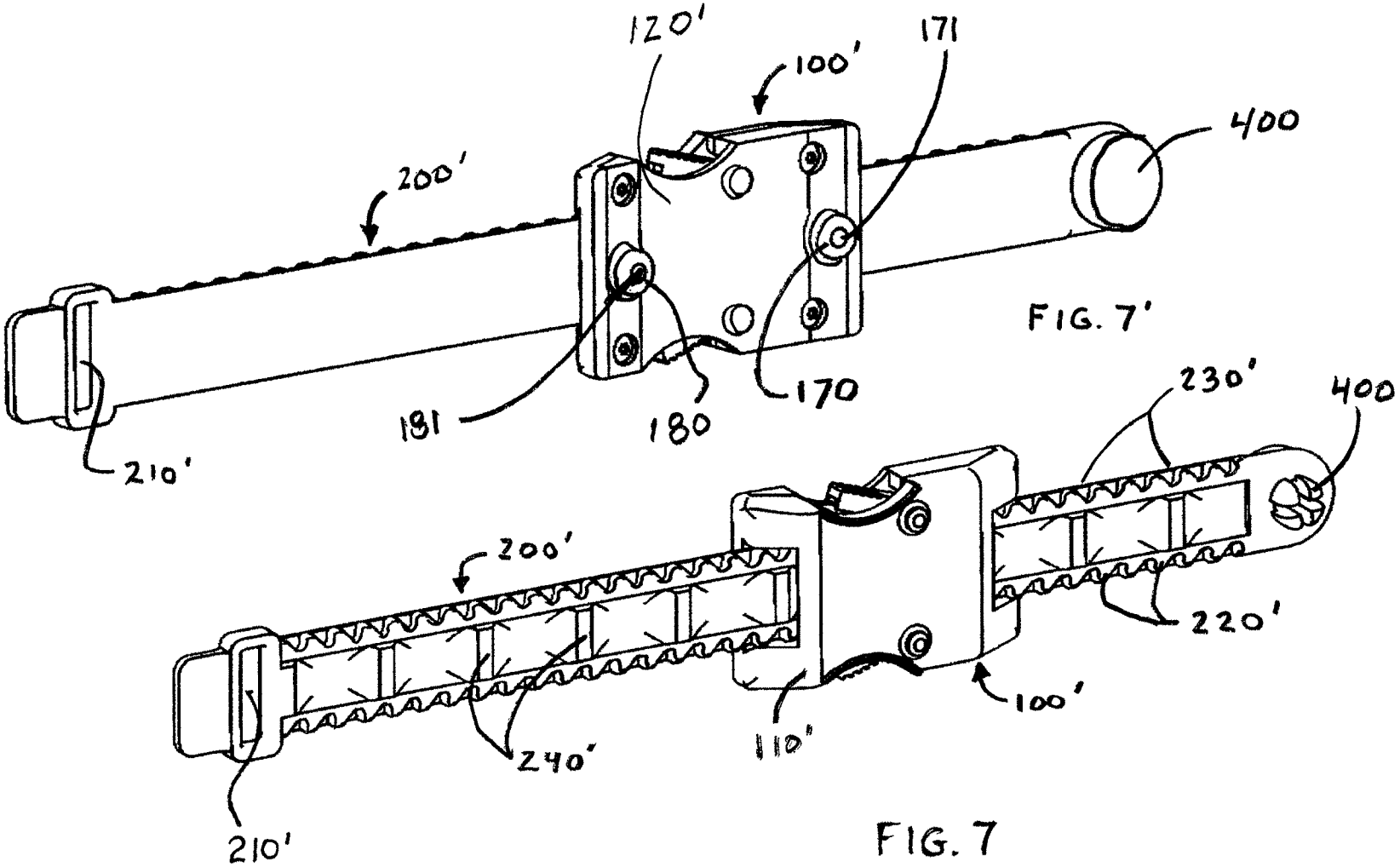

FIGS. 7 & 7' show full assemblies having top and bottom orientation of helment strap embodiment.

Figure 8:
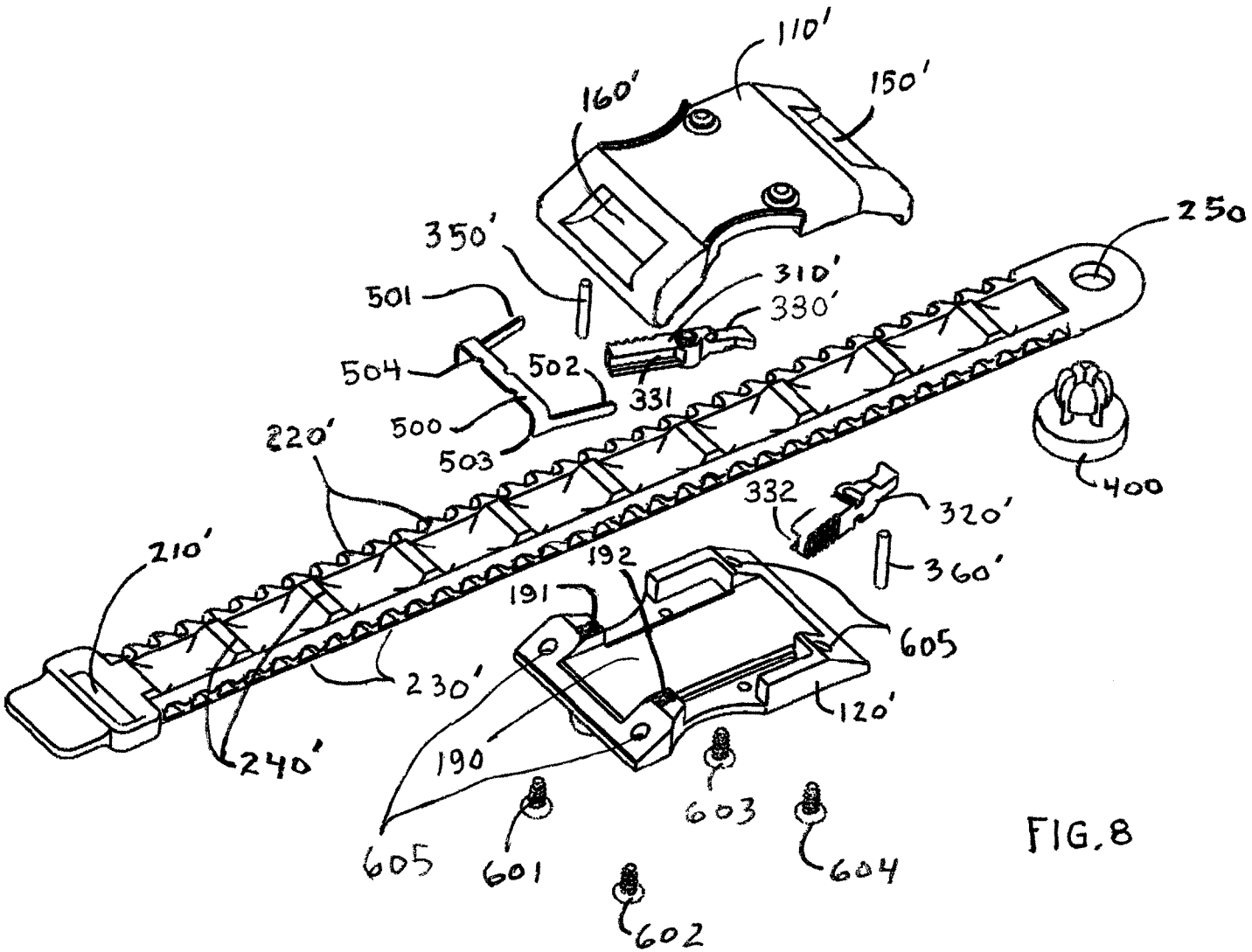

FIG. 8 shows exploded view of main components of helmet strap embodiment

Figure 9:
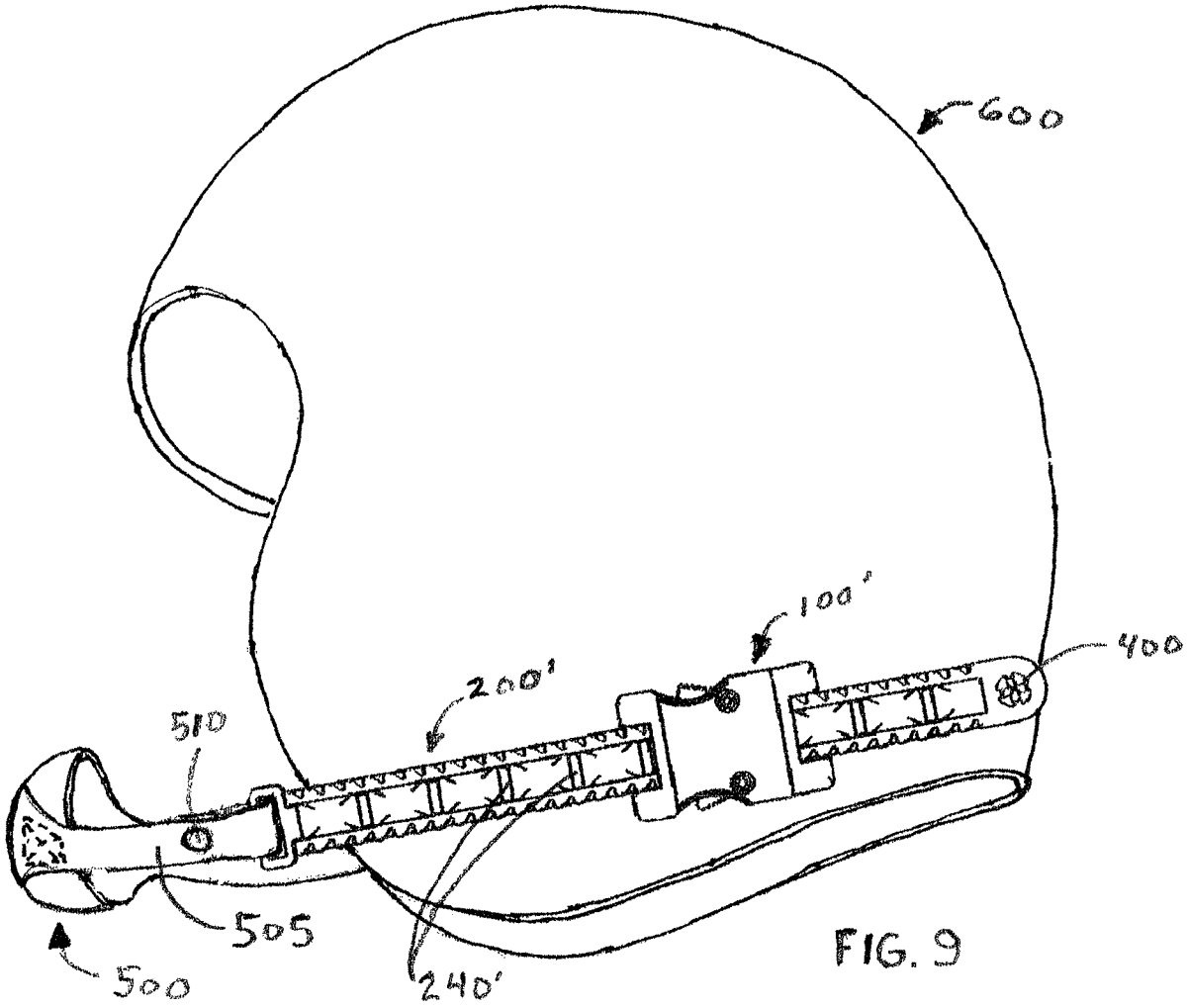
Figure 9:
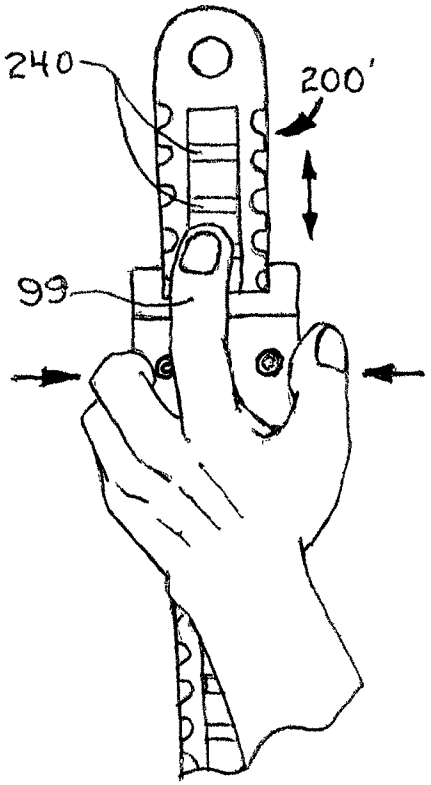

FIG. 9 shows helmet strap embodiment assembled to helmet and chin strap

Figure 10:
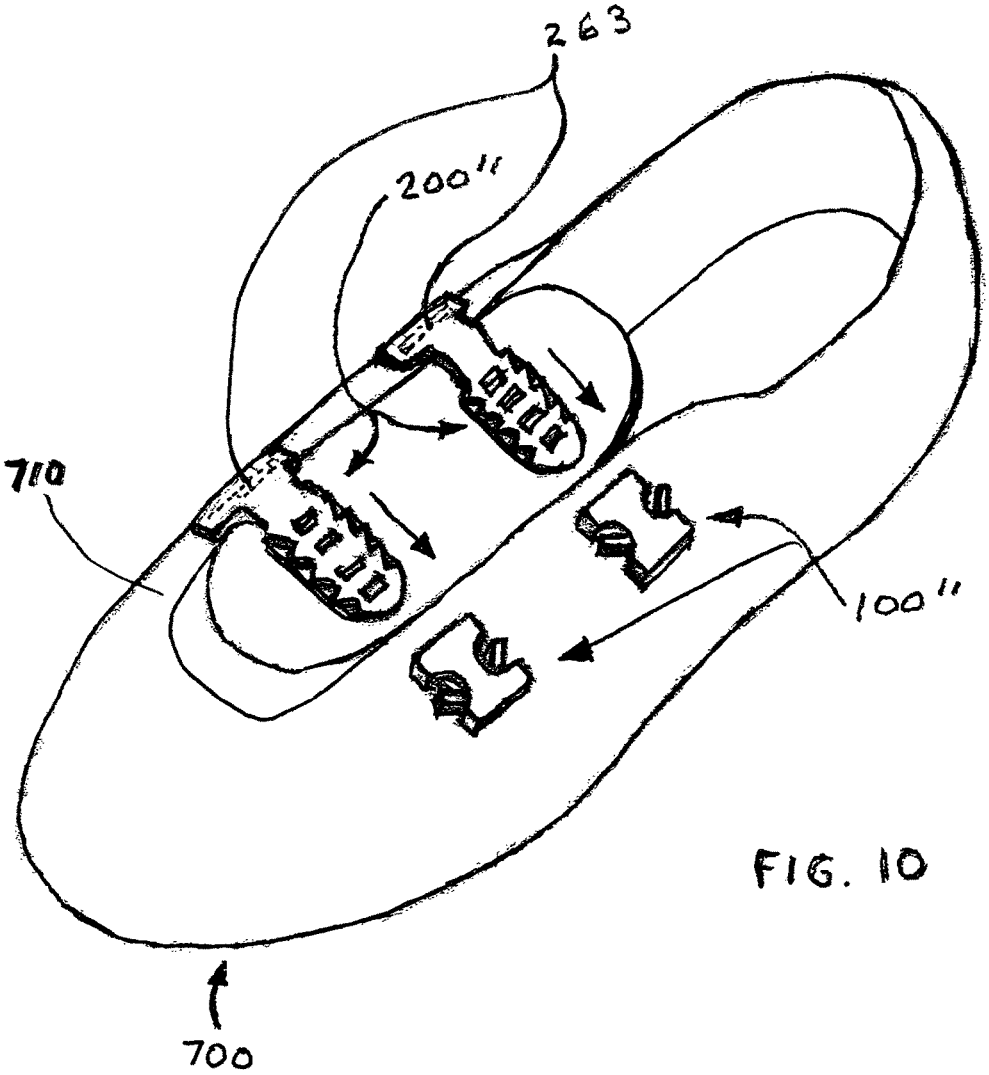

FIG. 9' illustrates hand-finger ergonomics during simultaneous side release actuation FIG. 10 shows full assembly of footwear embodiment

DETAILED DESCRIPTION OF BELT EMBODIMENT FIGS. [1-6]

The belt embodiment has a receiving enclosure assembly part 100 and an insertion structure part 200. Insertion part has an eyelet opening 210 to connect to a belt 130 and receiving part has crossbar 152 also for connecting to the belt. Belts can be configured for permanent attachment via stitching 132 to both insertion and receiving parts. Alternatively both the receiving part and insertion part may include several belt openings for and adjustable connection to an open ended belt.

The receiving enclosure has a top cover 110 and a bottom cover 120, and laterally located inverted latches 310 and 320. The receiving part also has an insertion opening 150 and an exit opening 160. Preferably insertion part is made of plastic material such as Nylon or Delrin thus providing flexibility yet good structural integrity for small features such as bosses and ridges. The receiving part can be made of metal or plastic depending on application requirements and cost targets.

Additionally, receiving part has a guide bridge 140 for assistance in containing portion of insertion part extending past of exit opening 160. A lengthwise dowel pin 370 helps secure the receiving enclosure's top and bottom covers 110, 120 thru simultaneous aligned insertion into a cylindrical opening 122 of the bottom cover and pockets 124 of the top cover.

For securing engagement, the insertion part has a series of lateral ridges 220 on either side of insertion structure 200 and an intervening protective rim 230 features following alongside. Also incorporated into insertion part are centrally placed contoured boss 240 features that help increase lateral flexural stiffness of insertion structure 200 and have dual benefit of providing ergonomic finger access thereby facilitating control of insertion part movement, as referenced in FIG. 9', also polarizing insertion orientation to opening 150.

Figure 1:
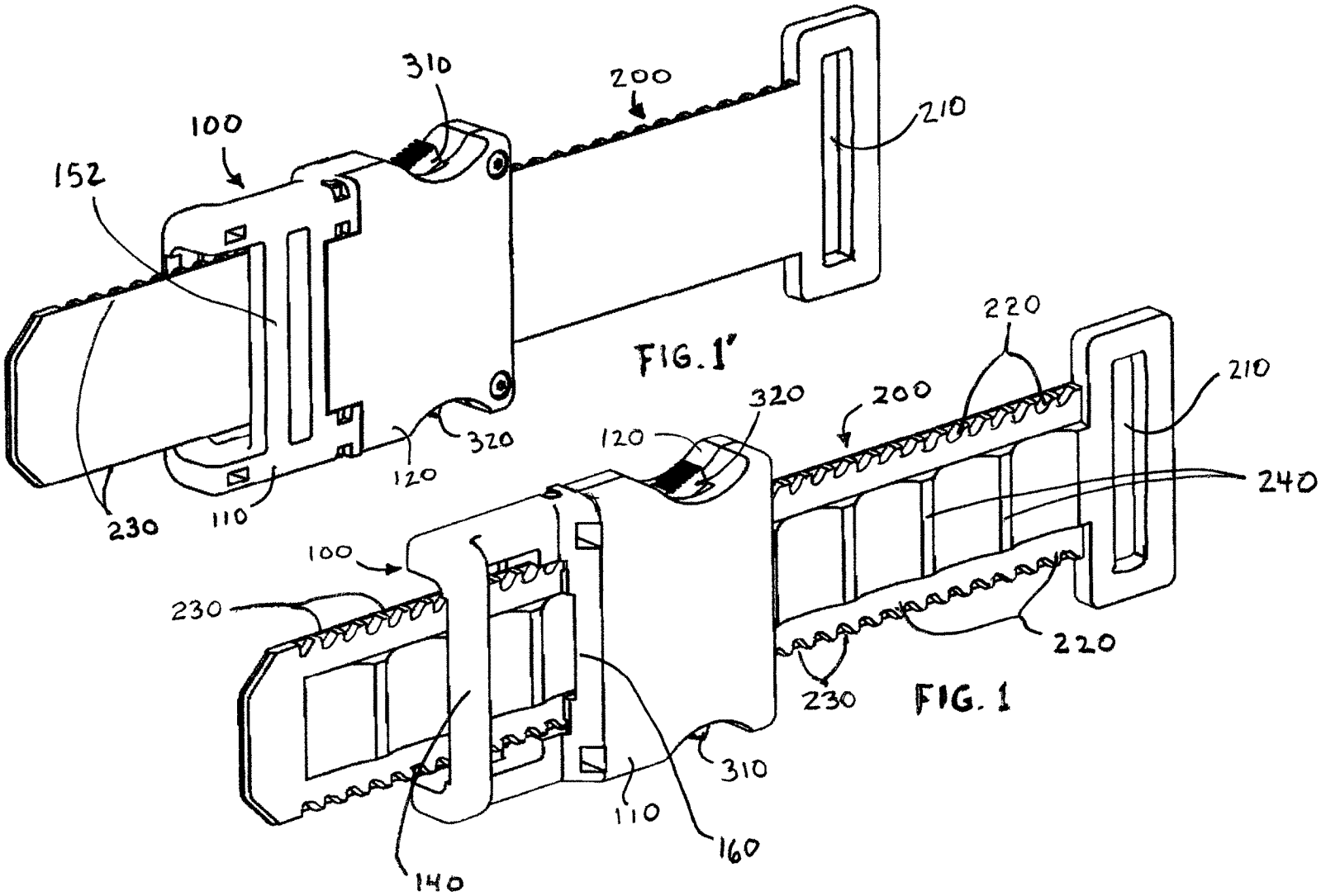
Figure 2:
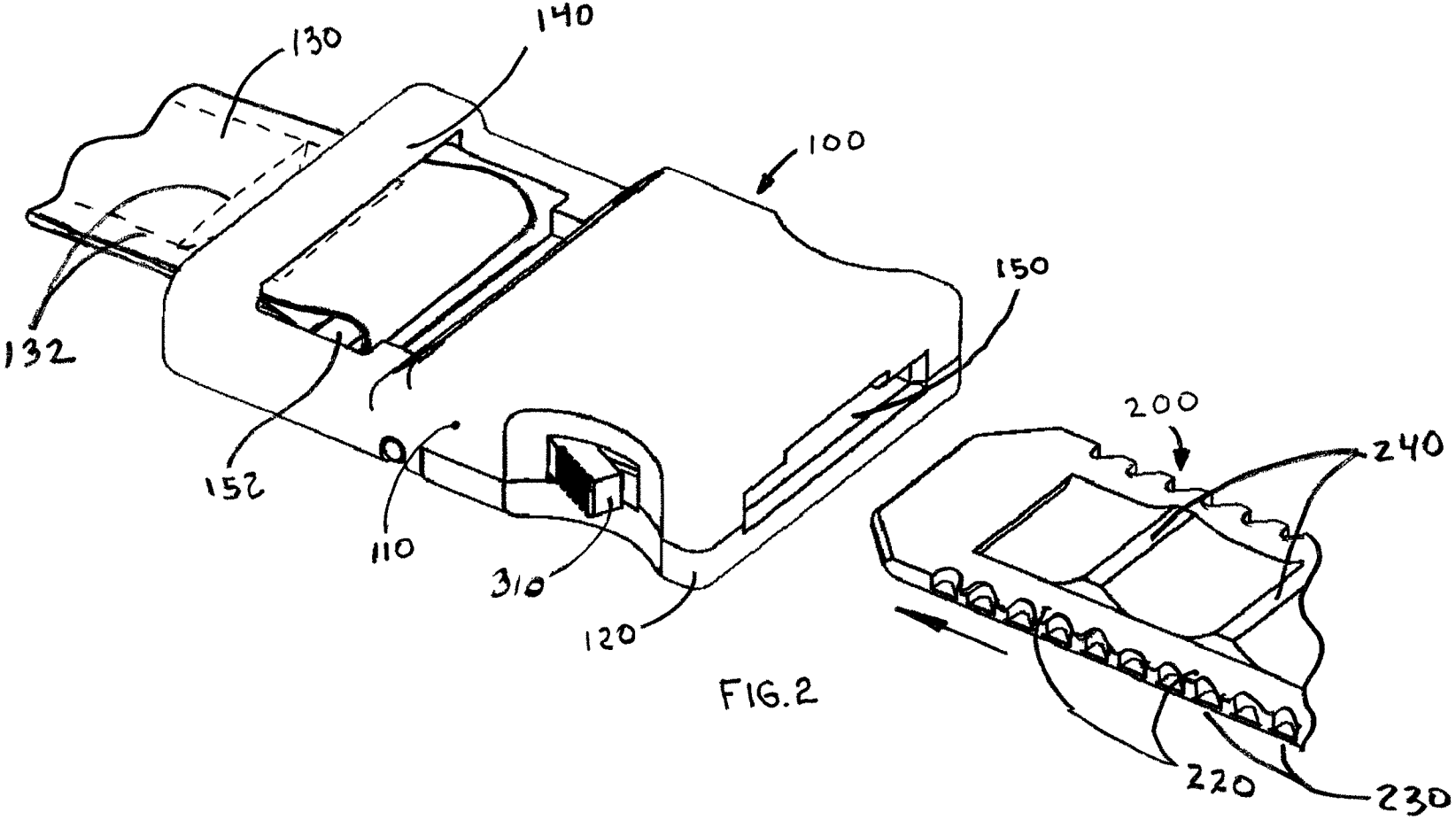
FIG. 2 shows closer view of receiving enclosure assembly with belt attached and insertion structure.
Figure 3:
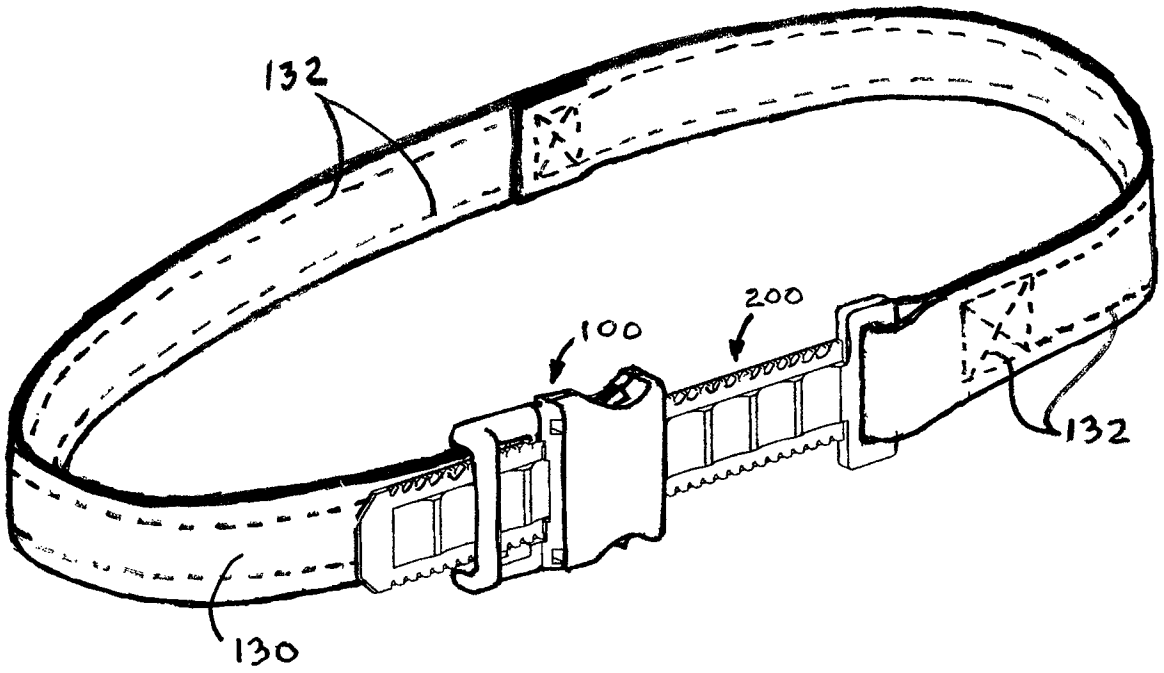
FIG. 3 shows full 360 degree belt and fastener configuration.
Figure 4:
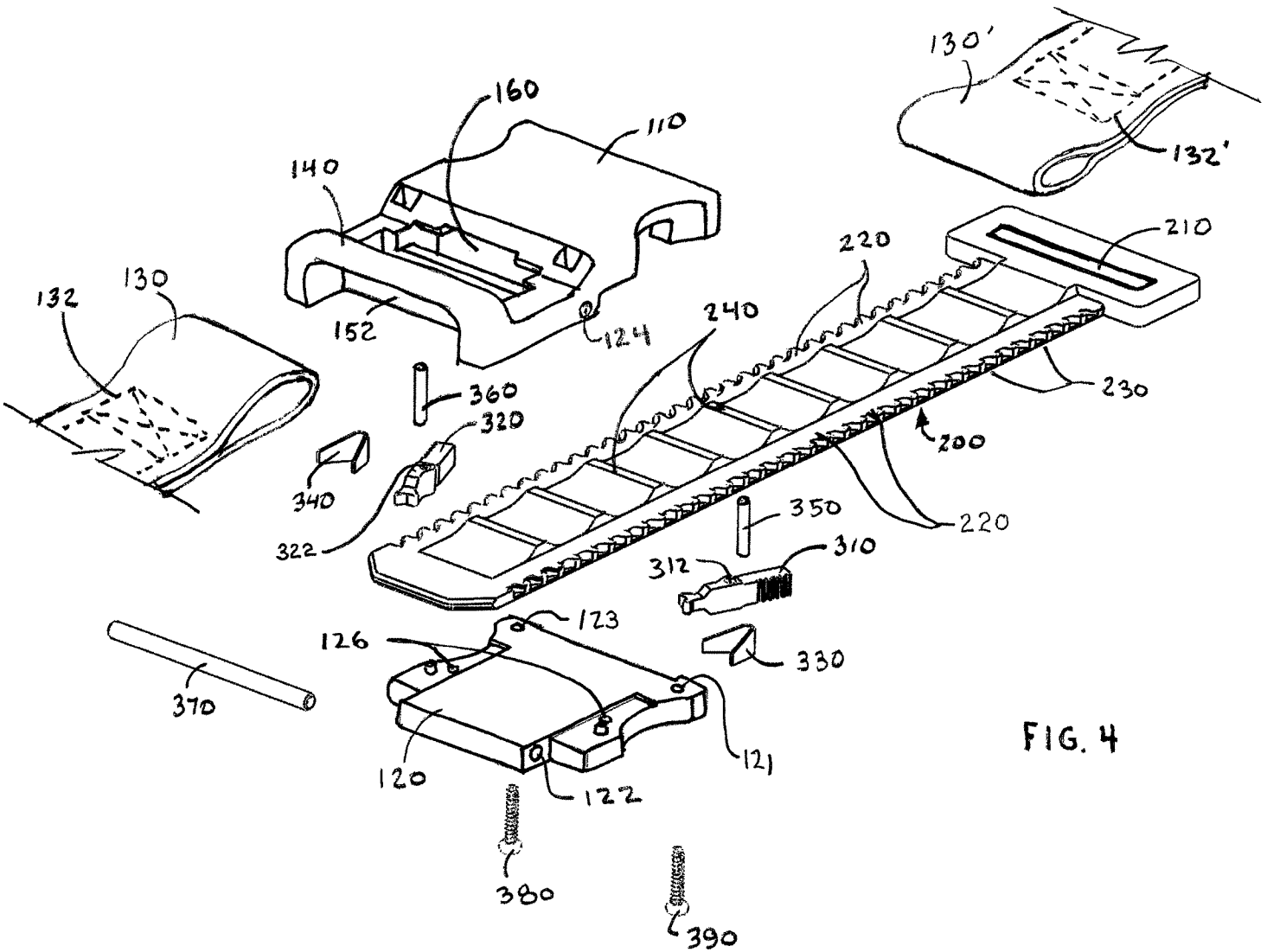
FIG. 4 shows exploded view of main components of belt embodiment.
Figure 5:
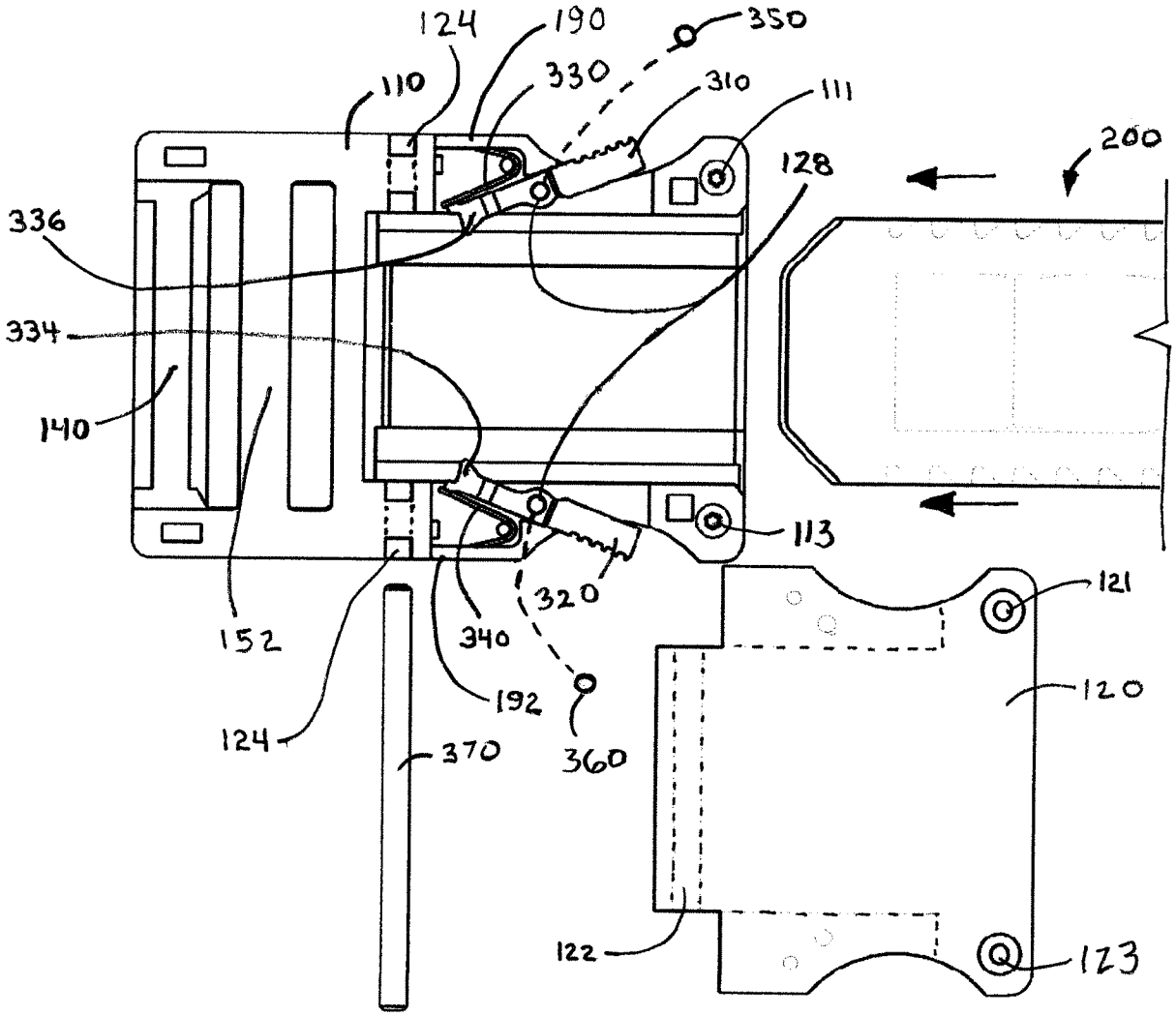
FIG. 5 shows bottom orthogonal view of receiving enclosure assembly with bottom cover removed.
Figure 6:
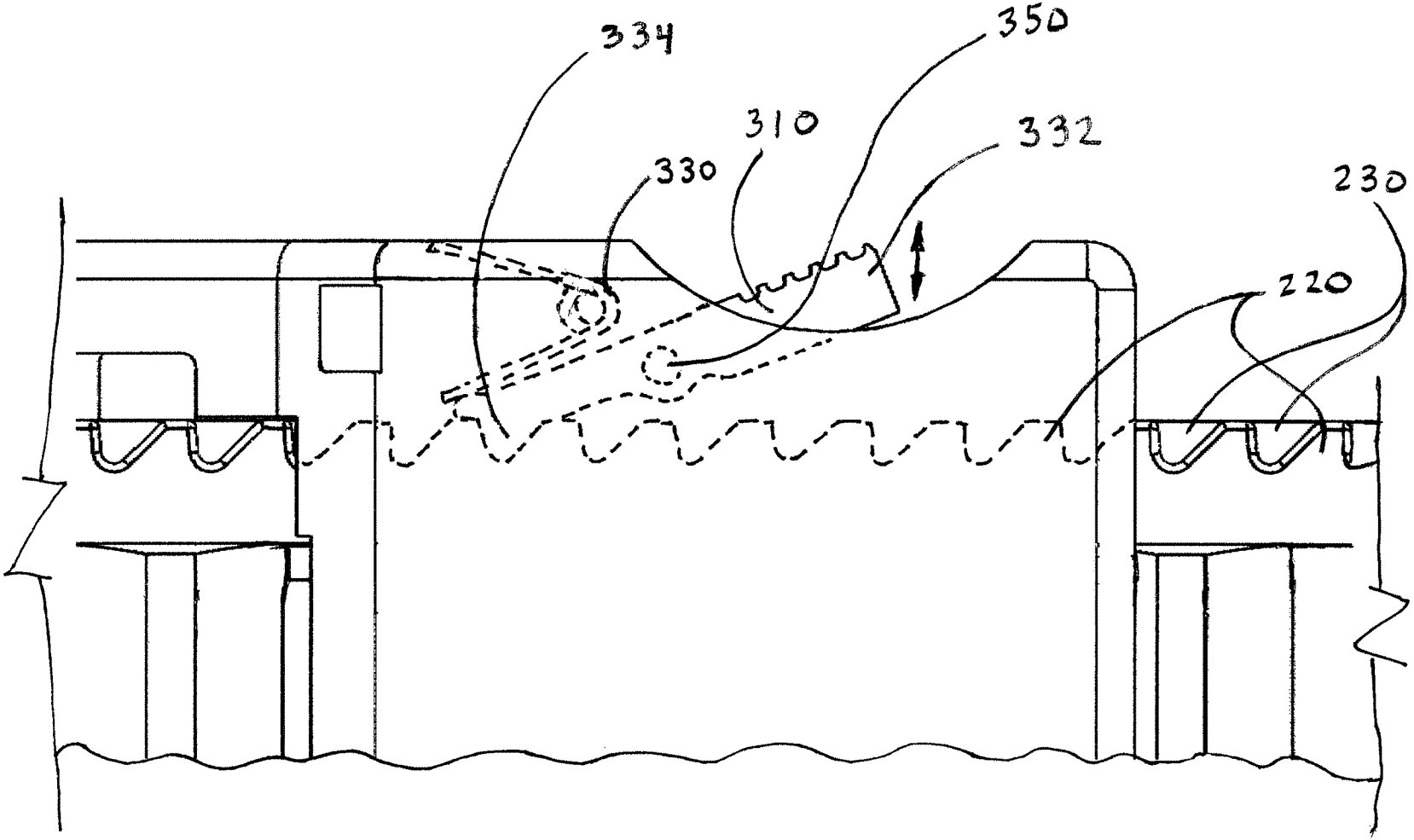
FIG. 6 shows close up of pivoting transverse latch engaged with insertion structure ridges.

Receiving part top and bottom covers contain a set of pockets 126, 128 sized for receiving and securing end portions of dowel pins 350, 360. The latches are constrained in pivoting fashion within receiving part via assembly of the dowel pins thru cylindrical latch holes 312, 322 and subsequent placement of dowel pin end portions into pockets 126, 128. A pair of v-shaped compliant springs 330, 340 is placed between interior side walls 190, 192 of top cover 110, and end tips 334, 336 of pivoting latches proving a passive inward pivoting bias. As can be shown in FIG. 6 detail, the pivoting latch tips 334, 336, are contoured to profile match corresponding insertion part lateral ridges 220. The pivoting latches have protruding surfaces 310, 320 extending out from lateral sides of receiving enclosure assembly part 100 so that when these surfaces are simultaneously pushed inward they pivot and end tips 334, 336 separate from lateral ridges 220 of insertion structure 200.

Final assembly of receiving part is top and bottom covers 110, 120 is accomplished by inserting screws 380, 390 thru bottom cover clearance openings 121, 123, and threading top cover holes 111, 113.

Detailed Description of Helmet Embodiment—FIGS. 7, 7', 8, 9

A helmet strap embodiment is shown in FIGS. 7, 7', 8, and 9. In the interest of clarity, components with equivalent function to aforementioned belt embodiment will have similar number with the addition of a prime symbol (').

Helmet embodiment receiving enclosure 100' eliminates structure for attaching to a belt and adds peg features 170, 180 to use as attachment means to helmet shell 600. A matching set of holes is made to helmet shell (not shown) that allows the pegs to pass thru shell and subsequently bottom cover 120' to sit flush with helmet outer surface. The pegs have threaded holes 171, 181 for receiving a screw fastener that gets threaded from inside the helmet shell and thereby rigidly secures the receiving enclosure to helmet.

Helmet embodiment insertion structure 200' has a hole 250 for receiving snap button 400 after first insertion thru receiving part. Function of button is to keep strap tethered to helmet 100% of the time, thus eliminating need to re insert. FIG. 8 details a spring clip 500 whose function replaces aforementioned v-shaped compliant springs 330, 340. Clip cantilever beams 501, 502 apply outward force on notched surfaces 331, 332 of inverted latches 310, 320 and so induce a inward bias of latch tips. Clip outer corners 503, 504 are fitted up with slots 191, 192 of bottom cover 120' in order to secure placement. Screws 601, 602, 603, 604 pass thru bottom four cover corner holes 605 and thread into top cover to secure receiving enclosure assembly 100'. A chin strap 500 attaches to insertion structure 200' by strap 505 passing thru eyelet 210' and then folding back over to engage with a rivet 510. FIG. 9 illustrates ease of one handed release operation with use of index finger 99 to control movement of insertion structure 200'.

Detailed Description of Footwear Embodiment—FIG. 10

FIG. 10 illustrates a footwear embodiment. A shoe 700 has insertion structures 200" stitched onto upper canvas 710 thru end pads 263. Receiving enclosures 100" can be secured to canvas using peg(s) a manner similar to helmet embodiment, or in an alternate configuration it can include flange structure(s) with holes to accommodate riveting as attachment means.

Advantages

Accordingly several advantages of one or more aspects are as follows: Device allows for manual quick connect, quick disconnect and quick adjustment of fastening arrangements. In accordance to one embodiment fastening device eliminates necessity for disconnection to re-lace belts thru attachment loops or prong holes as means of sizing adjustment, and includes peripheral intervening protective rim to protect exposed insertion structure ridges. Ratcheting configuration is of simple construction and can be manufactured inexpensively. In accordance to another embodiment fastening device allows for easy one handed finger adjustment incorporating ergonomic contoured features within center section of semi-rigid insertion structure.

CONCLUSIONS, RAMIFICATIONS AND SCOPE

Although the description above may contain many specificities, these should not be construed as limiting the scope of the embodiments but as merely providing illustrations of some of several embodiments. For example the rigid lengthwise insertion structure can have other cross sectional shapes such as circular, oval, square, etc., and correspondingly its receiving shell enclosure cross section can also be modified to accommodate. Additionally, extension features of insertion structure and/or receiving enclosure so as to attach to a multitude of additional surfaces either flexible or rigid can be readily accommodated with multitude of common attachment methods.

I claim:

1. A buckle fastener mechanism comprising:

a lengthwise semi rigid insertion structure having lateral, opposing ridges with an adjacent peripheral intervening protective rim, a receiving shell enclosure having an insertion opening and an exit opening configured to slide-ably receive said insertion structure, said insertion structure and said insertion opening having complementary cross sections allowing the insertion structure to be inserted into the insertion opening in only a single orientation, said receiving shell enclosure comprising pivoting latches resiliently and pivotably secured on opposed lateral sides of said receiving shell enclosure, said pivoting latches each comprise a protruding surface and a catch feature wherein the pivoting latches are secured on the receiving shell enclosure such that the protruding surface extends outward from a periphery of the lateral side of said receiving shell enclosure and the catch feature extends into the receiving shell enclosure and engages one of said opposing ridges of the insertion structure in a manner to allow a ratcheting movement of the insertion structure in an insertion direction and prevent movement of the insertion structure in an extraction direction, and a fastener release is accomplished through simultaneous application of manual inward force to the protruding surfaces of said pivoting latches pivoting said pivoting latches thereby disengaging said catch features from said insertion structure while also inducing an extraction force in the extraction direction on said insertion structure.

2. The buckle fastener mechanism of claim 1 whereby said insertion structure comprises a central protruding structure for one handed finger manipulation, said central protruding structure and a complementary portion of said insertion and exit openings restricting insertion of said insertion structure in only said single insertion orientation.

* * * * *